US011453188B2

(12) United States Patent
Dykstra et al.

(10) Patent No.: US 11,453,188 B2
(45) Date of Patent: Sep. 27, 2022

(54) BIASED RETAINER ASSEMBLY FOR WASTE CONTAINER

(71) Applicant: Sebright Products, Inc,., Hopkins, MI (US)

(72) Inventors: Loren Dykstra, Holland, MI (US); Patrick Fein, Dorr, MI (US)

(73) Assignee: Sebright Products, Inc., Hopkins, MI (US)

( * ) Notice: Subject to any disclaimer, the term of this patent is extended or adjusted under 35 U.S.C. 154(b) by 431 days.

(21) Appl. No.: 16/397,101

(22) Filed: Apr. 29, 2019

(65) Prior Publication Data

US 2020/0009816 A1 Jan. 9, 2020

Related U.S. Application Data

(60) Provisional application No. 62/664,344, filed on Apr. 30, 2018.

(51) Int. Cl.
*B30B 9/30* (2006.01)
*B30B 15/08* (2006.01)
(Continued)

(52) U.S. Cl.
CPC ..... *B30B 9/3028* (2013.01); *B30B 9/301* (2013.01); *B30B 9/3042* (2013.01); *B30B 15/08* (2013.01);
(Continued)

(58) Field of Classification Search
CPC ..... B30B 9/3028; B30B 9/301; B30B 15/041; A01F 15/10; A01F 2015/048; A01F 2015/107
See application file for complete search history.

(56) References Cited

U.S. PATENT DOCUMENTS 521,511 A 6/1894 Schulze
2,139,928 A 12/1938 Blewett
(Continued)

FOREIGN PATENT DOCUMENTS

EP 0 392 842 A1 10/1990
GB 2 102 728 A 2/1983
(Continued)

OTHER PUBLICATIONS

Breaker Bar Weldment, Drawing # BBW-60-.5-060309, Blueprint dated Jun. 3, 2009, 1 page, Sebright Products Inc., Hopkins, Michigan USA.
(Continued)

*Primary Examiner* — Andrew T Kirsch
(74) *Attorney, Agent, or Firm* — McGarry Bair PC

(57) ABSTRACT

A retainer assembly for a waste container opening defining a longitudinal axis passing through a center of the opening includes a framework defining a first framework opening, and a pivotable finger assembly including a retainer portion, the retainer portion pivotably adjacent the first framework opening. The finger assembly includes a biasing element for urging the retainer portion toward the longitudinal axis. The retainer portion is movable against the biasing element away from the longitudinal axis to enable placement of waste materials into the waste container, and movable toward the longitudinal axis after waste materials have been placed into the waste container to impede movement of waste materials through the first framework opening out of the waste container.

19 Claims, 16 Drawing Sheets

(51) Int. Cl.

| | |
|---|---|
| ***B65D 5/16*** | (2006.01) |
| ***B65D 25/00*** | (2006.01) |
| *B65D 88/54* | (2006.01) |
| *B65D 5/72* | (2006.01) |
| *B65F 1/14* | (2006.01) |

(52) U.S. Cl.
CPC ..... *B65D 5/16* (2013.01); *B65D 25/005* (2013.01); *B65D 5/724* (2013.01); *B65D 88/54* (2013.01); *B65F 1/1405* (2013.01)

(56) References Cited

U.S. PATENT DOCUMENTS

| | | | | |
|---|---|---|---|---|
| 2,660,949 | A | | 12/1953 | Russell |
| 2,822,750 | A | | 2/1958 | Austin |
| 3,499,558 | A | | 3/1970 | Rey |
| 3,693,541 | A | | 9/1972 | Lombard et al. |
| 3,739,715 | A | | 6/1973 | Ambrose |
| 3,996,850 | A | | 12/1976 | Whitener |
| 4,023,484 | A | | 5/1977 | Schafer et al. |
| 4,182,236 | A | * | 1/1980 | Greer ..... B30B 9/3014 100/218 |
| 4,271,756 | A | | 6/1981 | Bettencourt |
| 4,426,927 | A | | 1/1984 | Teague |
| 4,748,908 | A | | 6/1988 | Feezor et al. |
| 5,056,428 | A | | 10/1991 | Allen |
| 5,456,075 | A | * | 10/1995 | Meijer ..... A01F 15/10 100/189 |
| 5,590,594 | A | | 1/1997 | Pederson |
| 5,740,726 | A | | 4/1998 | Schwelling |
| 6,412,406 | B1 | | 7/2002 | Flood et al. |
| 6,418,841 | B1 | | 7/2002 | Little et al. |
| 7,077,060 | B2 | | 7/2006 | Eriksen |
| 7,743,717 | B2 | | 6/2010 | Vera |

FOREIGN PATENT DOCUMENTS

| | | | |
|---|---|---|---|
| WO | 02/062565 | A1 | 8/2002 |
| WO | 2007/068956 | A2 | 6/2007 |

OTHER PUBLICATIONS

Breaker Bar Weldment, Drawing # BBW-60-1H-011711, Blueprint dated Jun. 3, 2009, 1 page, Sebright Products Inc., Hopkins, Michigan USA.

Breaker Bar Weldment, Drawing # BBW-60-1-120309, Blueprint dated Dec. 3, 2009, 1 page, Sebright Products Inc., Hopkins, Michigan USA.

* cited by examiner

BIASED RETAINER ASSEMBLY FOR WASTE CONTAINER

CROSS REFERENCE TO RELATED APPLICATION

Field of the Invention

This application claims the benefit of U.S. Application Ser. No. 62/664,344 filed Apr. 30, 2018, the entirety of which is incorporated herein.

BACKGROUND

Field of the Invention

In one aspect, the present disclosure relates to an assembly for enabling waste materials to be placed through an opening into a container while impeding the movement of the waste materials out of the container.

Description of the Related Art

Waste containers, particularly large industrial-type containers, are frequently filled with waste materials by a reciprocating ram moving the waste materials into the container. The container is provided with an opening through which the ram moves the waste materials. When the ram is retracted from the container, waste materials can move out of the container through the opening. Containers are typically coupled semi-permanently with the ram to expedite the filling of the containers. However, this prevents the use of a door to close the opening during times when the container is not being filled. Consequently, waste materials previously compacted into a container can gradually expand and escape the container through the opening.

BRIEF DESCRIPTION

In one aspect, a retainer assembly for a waste container has a frame defining an opening, where the frame is configured to mount to a waste container having an interior, and the frame has a side adapted to face the interior. A plurality of finger brackets is disposed on the frame, spaced from each other and positioned around most of the opening. Each finger bracket has a pin. A set of plate like fingers is also disposed on the frame, each plate like finger having a proximal end pivotally mounted to the pin of each finger bracket and movable between a retaining position where a distal end extends at a first angle from the side adapted to face the interior toward the opening, and an open position where the distal end is free from the opening. A torsion spring is mounted between each finger bracket and each plate like finger to bias the plate like finger to the retaining position. Each of a subset of plate like fingers in the retaining position has a proximal portion extending from the finger bracket and a distal portion that extends from the proximal portion at a second angle relative to the first portion.

In another aspect, a waste container, having an open end and defining an interior, includes a retainer assembly having a frame defining an opening, and having a side facing the interior. A plurality of finger brackets is disposed on the frame, spaced from each other and positioned around most of the opening. Each finger bracket has a pin. A set of plate like fingers is also disposed on the frame, each plate like finger having a proximal end pivotally mounted to the pin of each finger bracket and movable between a retaining position where a distal end extends at a first angle from the side toward the interior and the opening, and an open position where the distal end is free from the opening. A torsion spring is mounted between each finger bracket and each plate like finger to bias the plate like finger to the retaining position. Each of a subset of plate like fingers in the retaining position has a proximal portion extending from the finger bracket and a distal portion that extends from the proximal portion at a second angle relative to the first portion.

DESCRIPTION

Figure 1:
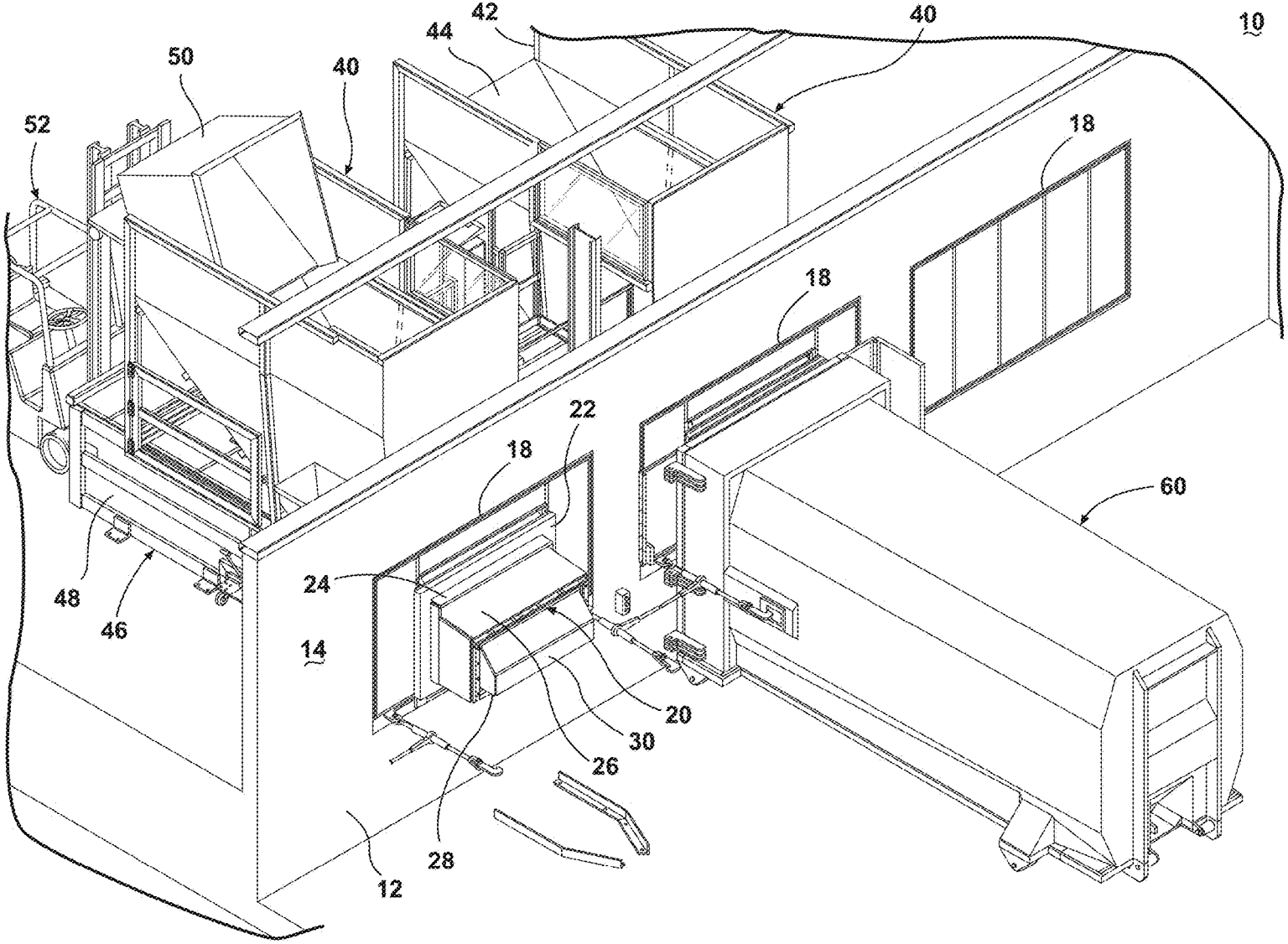
FIG. 1 is a first perspective view of a portion of a waste removal facility providing an environment for a transportable waste container and retainer assembly according to aspects of the present disclosure.
Figure 2:
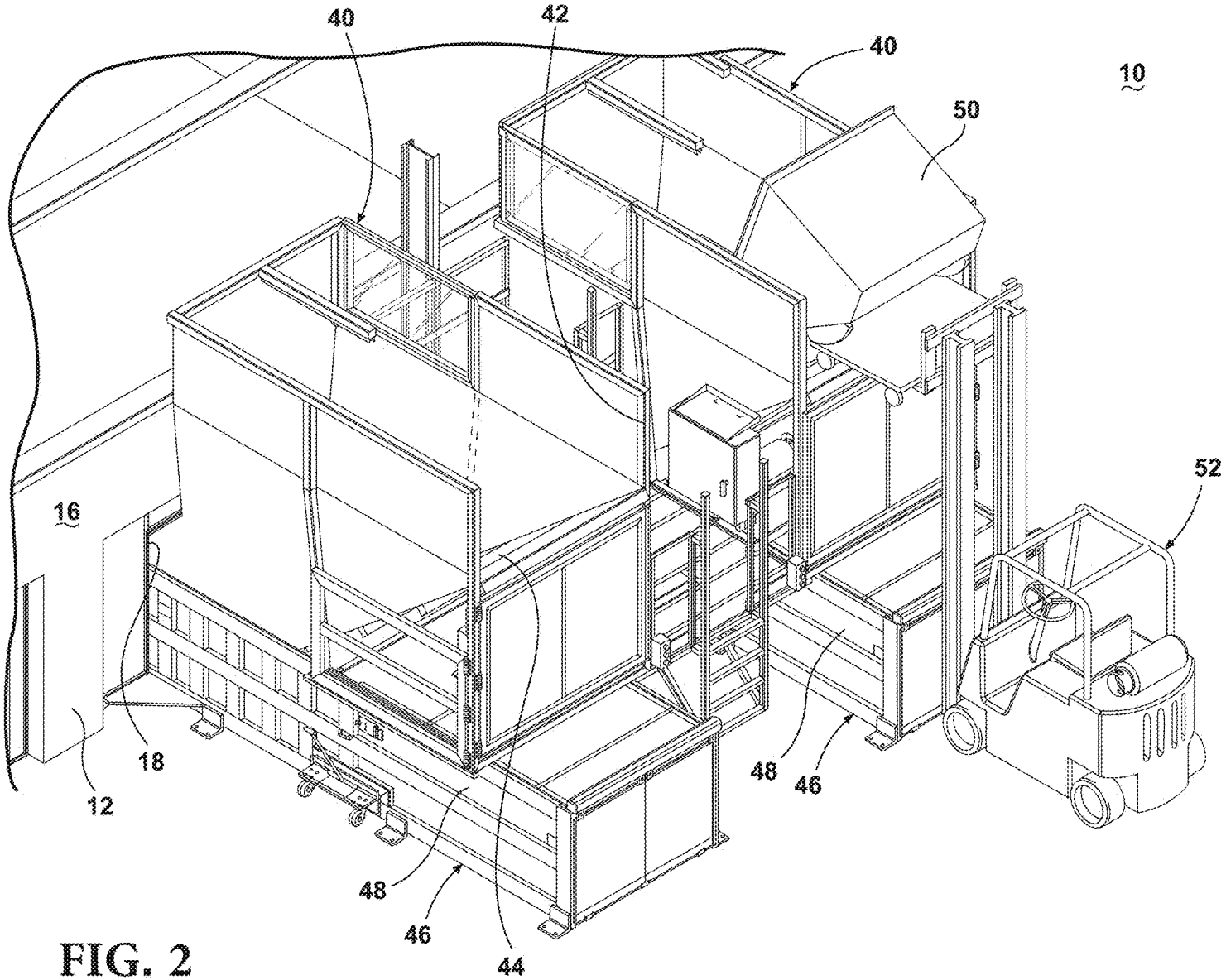
FIG. 2 is a second opposed perspective view of the portion of the waste removal facility illustrated in FIG. 1.

FIG. 1 and FIG. 2 illustrate a portion of a waste removal facility 10 from opposite perspectives. The waste removal facility 10 is exemplary only, and intended to show an environment in which aspects of the present disclosure can be utilized. It forms no part of the invention.

The waste removal facility 10 can include a barrier 12, such as a wall, having an obverse side 14 and a reverse side 16. One or more openings 18 can be provided through the barrier 12 for purposes described hereinafter. FIG. 1 illustrates a waste container 60 positioned against the obverse side 14 relative to an opening 18 for receiving waste materials delivered from a hopper assembly 40 adjacent the reverse side 16.

Figure 3:
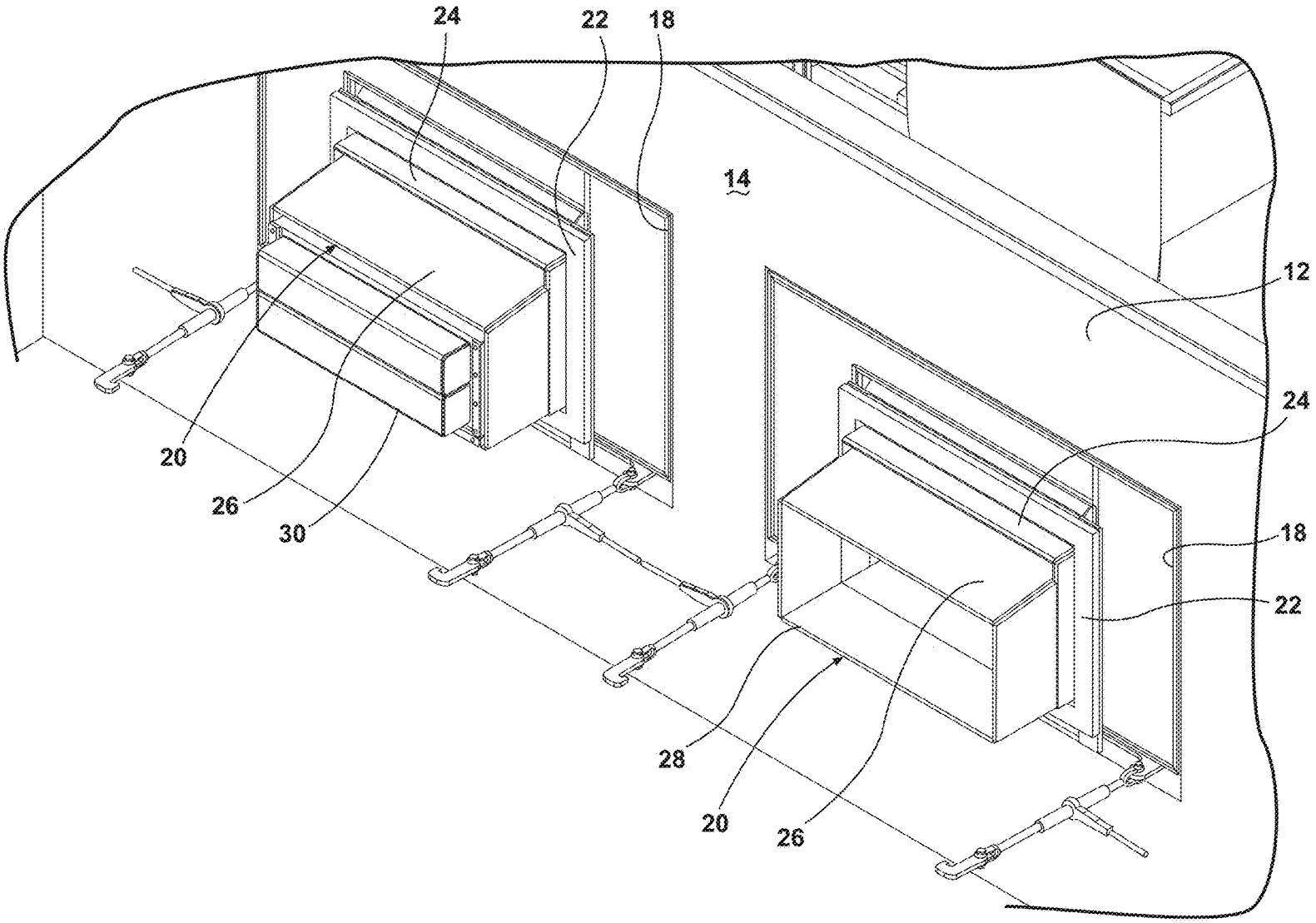
FIG. 3 is an enlarged perspective view of a portion of the waste removal facility of FIG. 1 illustrating a mechanism for delivering waste materials into a transportable waste container.

The opening 18 can include a snout assembly 20 extending away from the obverse side 14. Referring also to FIG. 3, the snout assembly 20 can include a gasket 22, a snout 24, a snout extension 26, and a snout opening 28. The gasket 22 is illustrated as a generally right-angled body that can be disposed relative to the opening 18 and the snout 24 against the obverse side 14 to serve as a cushion and seal between the obverse side 14 and the waste container 60. The gasket 22 can include a known gasket material having sufficient thickness and durability for the purposes described herein.

The snout 24 is illustrated as a generally right-angled frame-like body that can extend through the opening 18 from a ram assembly 46, specifically a ram enclosure 48. The snout extension 26 is a generally right-angled box-like body that can extend from the obverse side 14 through the snout 24 to ensure coupling with the waste container 60. The snout extension 26 defines the snout opening 28.

Referring specifically to FIG. 2, the hopper assembly 40 can include a generally known hopper for receiving waste materials and delivering waste materials to a ram assembly 46, and can include an enclosed box-like structure having an opening 42 through which waste materials can be introduced. The hopper assembly 40 can include an inclined bottom wall 44 to facilitate movement of waste materials downward from the opening 42 toward the snout assembly 20. In a known manner, the hopper assembly 40 can receive waste materials delivered in a selected manner, such as conveyors, elevators, transportable containers, and the like. FIG. 2 illustrates a refuse bin 50 transported by a bin transporter 52 in the process of discharging waste materials into the hopper assembly 40.

The hopper assembly 40 is also illustrated as operably coupled with and positioned above the ram assembly 46. The ram assembly 46 can include a ram enclosure 48 for enclosing a movable ram 30 (FIG. 1 and FIG. 3) and associated devices for operating the ram 30, such as a hydraulic or electric motor assembly, a control system, and associated mechanisms (not shown). When operable, the ram 30 can reciprocally move to extend beyond the snout opening 28 and retract away from the snout opening 28 (FIG. 3).

The various components making up the snout assembly 20 and hopper assembly 40 can include materials having sufficient strength and durability for the purposes described herein. For example, it may be preferable to utilize iron or steel for frameworks, receptacles, enclosures, and force-generating components.

The snout assembly, 20 hopper assembly 40, and ram assembly 46 are exemplary only, and intended to show an environment in which aspects of the present disclosure can be utilized. They form no part of the invention.

Figure 4B:
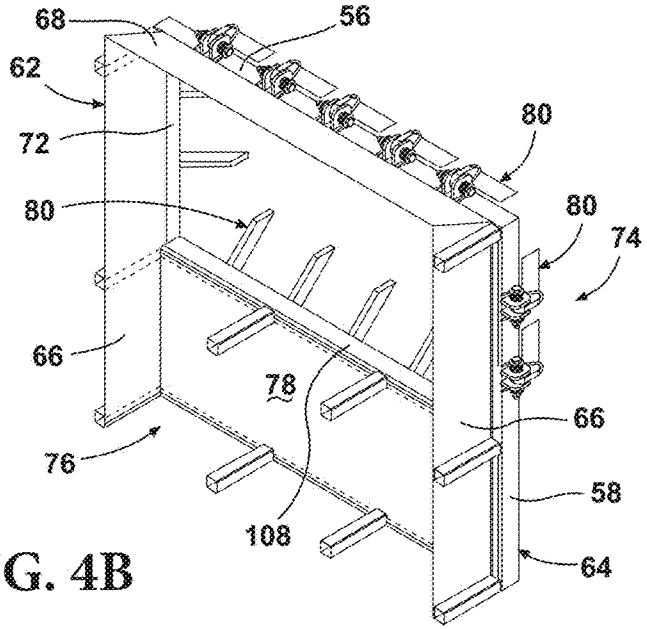
FIGS. 4A and 4B are perspective views of opposite sides of a retainer assembly that include a finger assembly.
Figure 5B:
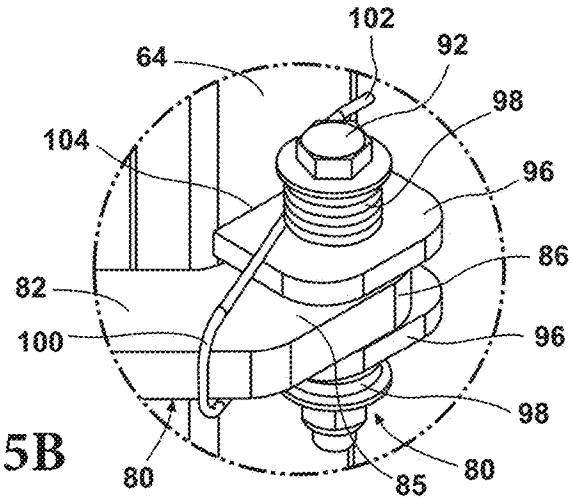
FIG. 5A-5E are enlarged perspective views of the finger assembly illustrated in FIG. 4A and FIG. 4B.
Figure 4A:
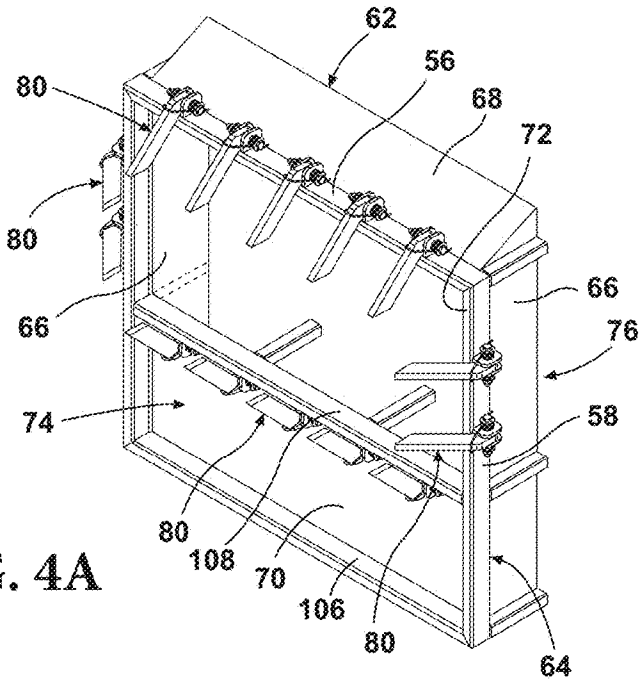

FIG. 4A and FIG. 4B illustrate one aspect of the present disclosure of a retainer assembly 62 that can include a generally right-angled reinforcing framework 64 with a top member 56, a bottom member 106, and an intermediate member 108 in spaced parallel disposition, orthogonally fixed to a pair of spaced, parallel side members 58. The top member 56, intermediate member 108, and associated portions of the side members 58, can define a first opening 72. The intermediate member 108, bottom member 106, and associated portions of the side members 58, can define a second opening. The second opening can be closed by a panel-like end wall 70 rigidly and orthogonally coupled with the intermediate member 108, bottom member 106, and associated portions of the side members 58.

The retainer assembly 62 can also include a pair of spaced, parallel plate-like sidewalls 66 rigidly and orthogonally coupled with the reinforcing framework 64, and an inclined, plate-like top wall 68 rigidly coupled with the reinforcing framework 64 and the sidewalls 66. The retainer assembly 62 can define an interior side 74 and an opposed exterior side 76.

A plurality of finger assemblies 80 extending somewhat angularly away from the reinforcing framework 64 and into the opening 72 can be mounted in a regular spacing to the top member 56, a portion of the side members 58, and the intermediate member 108. Referring to FIG. 5A-5E, a finger assembly 80 can include a somewhat plate-like finger body 81 with an elongated retainer portion 82 terminating in a distal end 84, transitioning through an obtuse angle to a relatively short pivot portion 85 terminating in a proximal end 86.

Figure 5A:
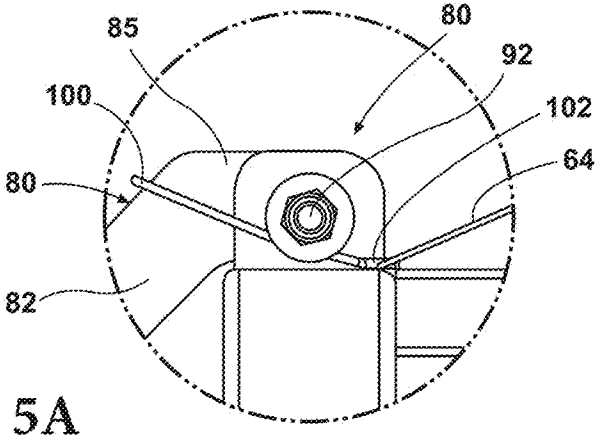
Figure 5D:
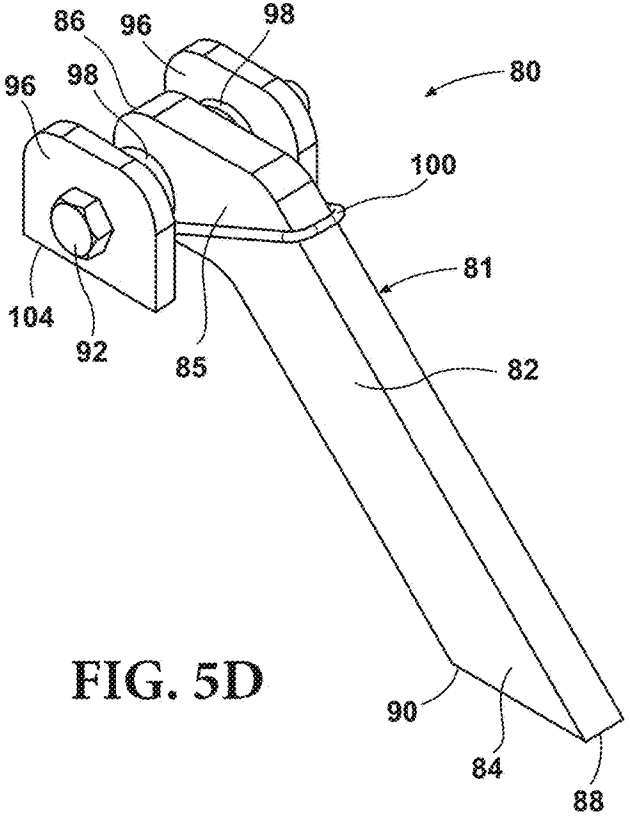
Figure 5C:
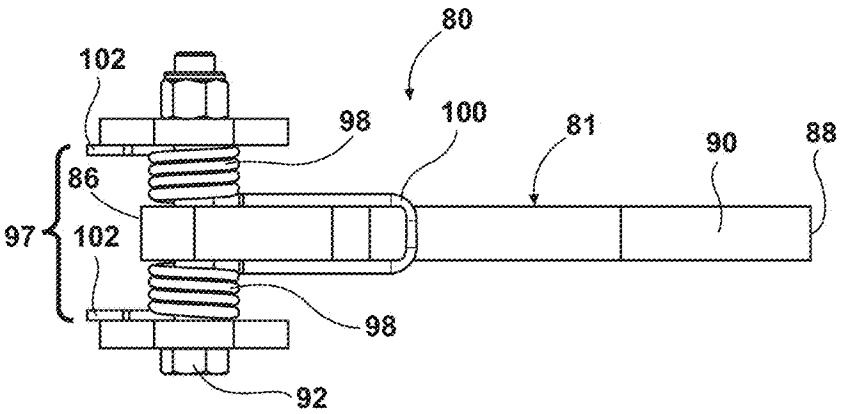
Figure 5E:
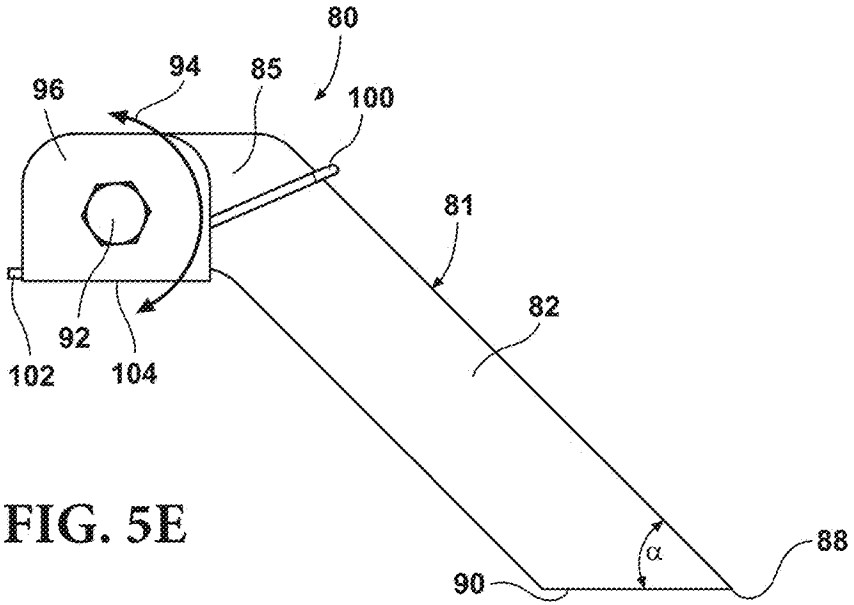

The distal end 84 can be configured with an acute tip 88 to define a planar finger surface 90 oriented at an angle $\alpha$ relative to the longitudinal axis of the retainer portion 82 (FIG. 5E). The pivot portion 85 can include a circular pivot opening (not shown) extending orthogonally therethrough for slidable receipt of a pivot pin 92, such as a threaded nut and bolt combination. The finger body 81 is described and illustrated as including a linear retainer portion 82. However, other configurations for the finger body 81 can be utilized. For example, the retainer portion 82 can be curved, or segmented into a selected number of relatively short portions joined together to define one or more obtuse angles.

A pair of plate-like finger brackets 96 in parallel, spaced-apart disposition can be positioned on both sides of the pivot portion 85 to enable pivotal movement of the finger body 81 about the pivot pin 92. The finger brackets 96 can be provided with a circular pivot opening (not shown) and a bracket wall 104. The finger brackets 96 can be fixedly attached to the top member 56, the side members 58, and the intermediate member 108, such as by welding, along the bracket wall 104 so that the pivot portion 85 of the finger body 81 can be slidably received between the finger brackets 96 with the pivot openings in the finger brackets 96 and the pivot portion 85 coaxially aligned to receive the pivot pin 92 therethrough.

When assembled, the finger body 81 can pivot about the pivot pin 92 alternately clockwise and counterclockwise as illustrated by the rotation vector 94 in FIG. 5E.

As illustrated in FIG. 5C, a biasing element 97 can include a pair of helical wire biasing elements 98 joined by a biasing yoke 100 and terminating in a pair of bearing ends 102, also referred to as a torsion spring. The biasing elements 98 can be adapted to bracket the pivot portion 85 in coaxial alignment with the pivot pin 92, the pivot portion opening, and the finger bracket openings. The biasing yoke 100 can be adapted to cross over and engage the retainer portion 82 of the finger body 81. The bearing ends 102 can be adapted to engage the top member 56, side members 58, and intermediate member 108 when the finger body 81, finger brackets 96, and biasing element 97 are assembled into the finger assembly 80. Alternatively, the biasing element 97 can include an assembly utilizing a flat spring, a helical compression spring, and the like.

The orientation of the biasing element 97 relative to the finger body 81 can bias the finger body 81 in a clockwise direction, as seen from the perspective of FIG. 5E. The finger body 81 can be rotated counterclockwise by a torque sufficient to overcome the clockwise biasing torque of the biasing element 97. When the torque is removed, the finger body 81 can be returned clockwise to an at-rest configuration under the influence of the biasing element 97.

Figure 6A:
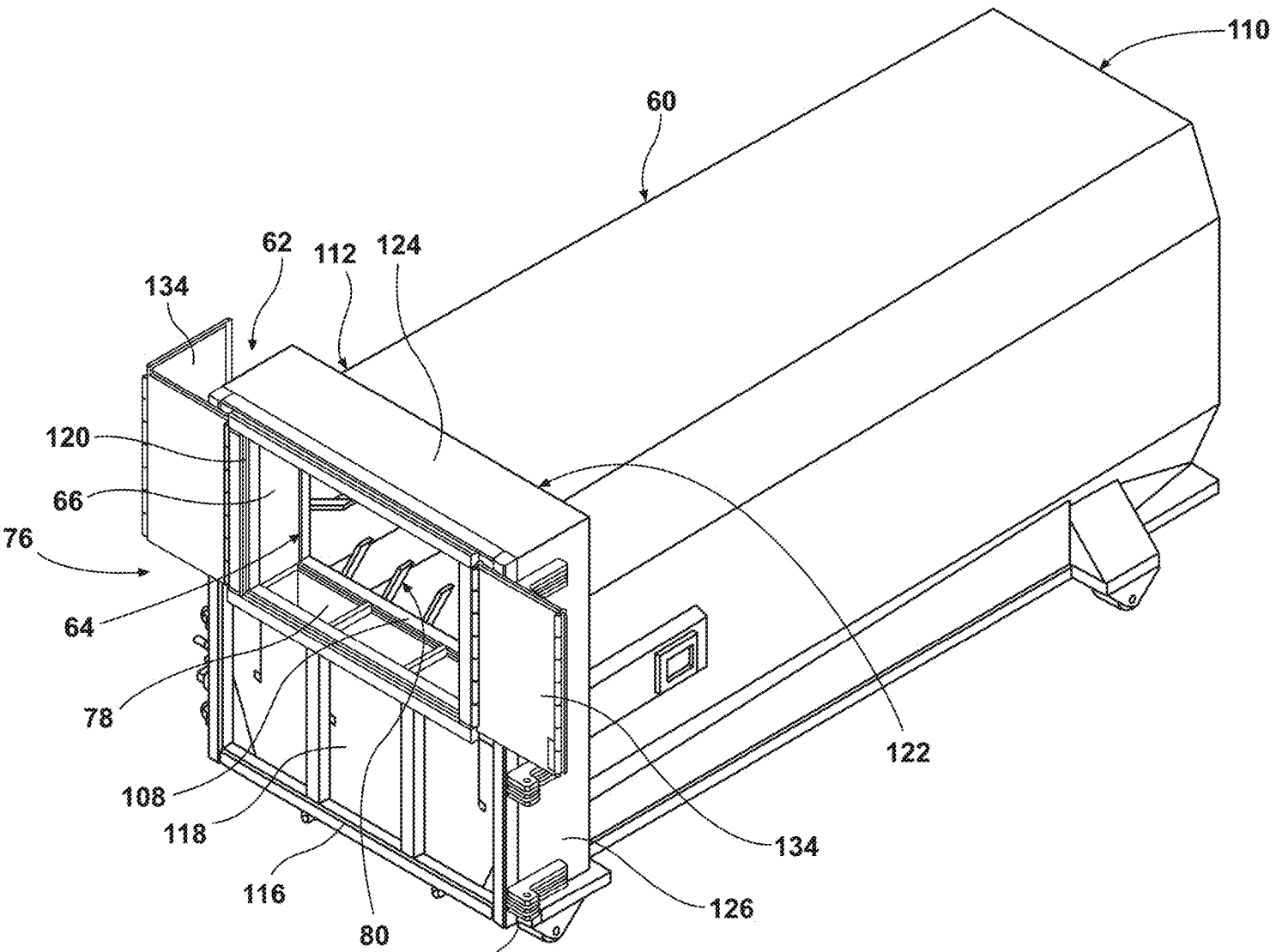
FIGS. 6A and 6B are perspective views of the transportable waste container of FIG. 1 illustrating the retainer assembly in a closed configuration, and in an open configuration, respectively.
Figure 6B:
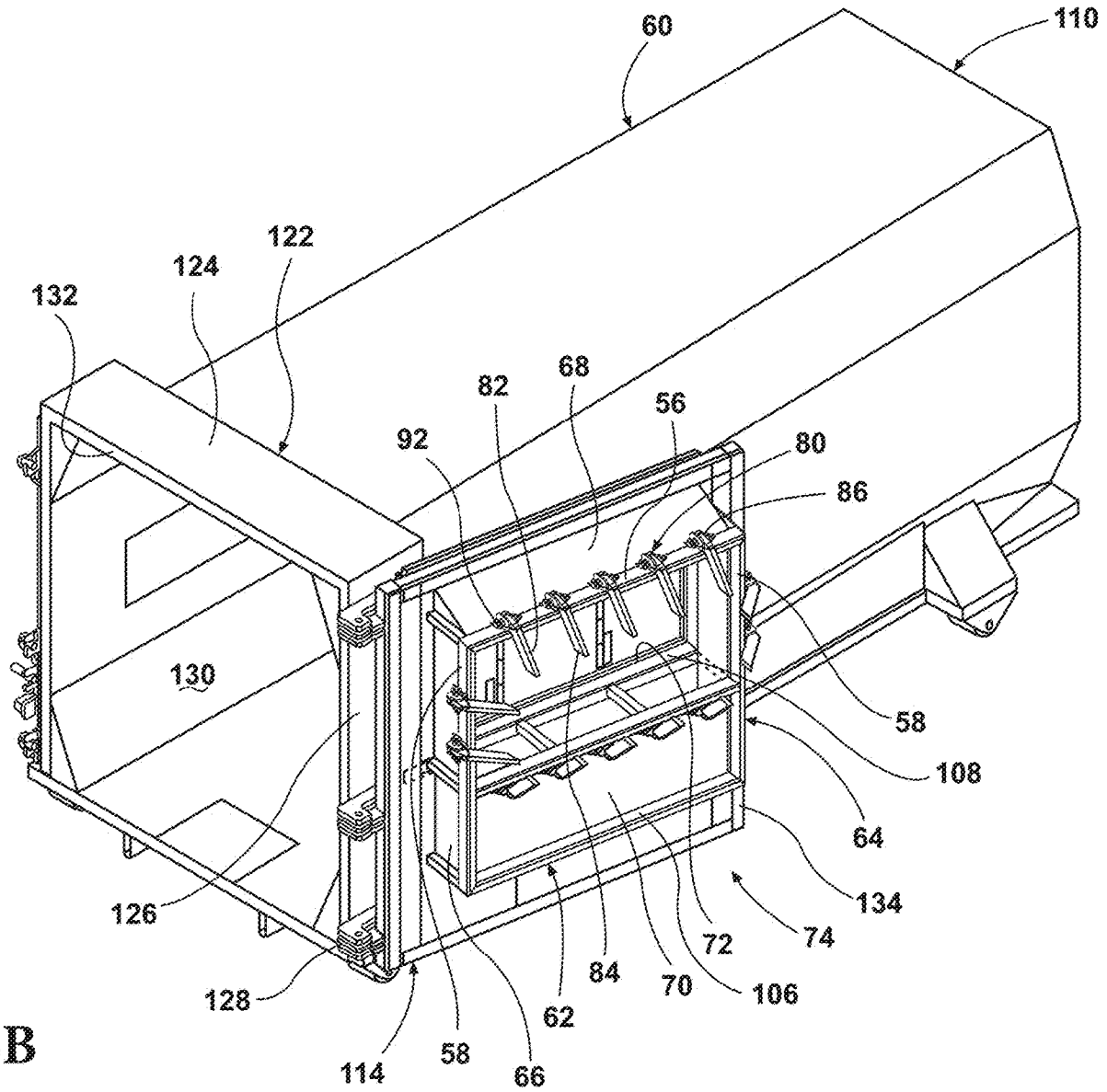

Referring now to FIG. 6A and FIG. 6B, the waste container 60 is illustrated with a closed end 110 and an opposed open end 112. The open end 112 can include a surrounding right-angled container opening collar 122 comprising a collar top wall 124 and a pair of spaced parallel collar sidewalls 126. A hinged door 114 configured to close the open end 112 can be attached to the collar sidewall 126. The hinged door 114 can be any selected configuration, and is illustrated as comprising a door reinforcing framework 116, the lower portion of which comprises a door wall 118.

A pair of waste opening doors 134 can be hingedly coupled with the hinged door 114 above the door wall 118, which can be selectively opened to provide access to the interior of the waste container 60 and closed to seal the interior of the waste container 60. The hinged door 114 can be attached to the container opening collar 122 by door hinges 128 having suitable strength and durability for the purposes described herein.

FIG. 6A illustrates the waste container 60 with the hinged door 114 in a closed configuration and the waste opening doors 134 in an open configuration. FIG. 6B illustrates the hinged door 114 in an open configuration, exposing the interior chamber 130 of the waste container 60. The container opening collar 122 can comprise a closure surface 132 against which the closed hinged door 114 can be sealed. The retainer assembly 62 can be attached to the hinged door 114 for enclosure in the waste container interior chamber 130 when the hinged door 114 is closed.

The retainer assembly 62 can be attached to the hinged door 114 so that the exterior side 76 of the retainer assembly 62 engages the interior surface of the hinged door 114, with the interior side 74 of the retainer assembly 62 facing away from the hinged door 114. When attached to the hinged door 114, the retainer assembly reinforcing framework 64 can be spaced away from the hinged door 114 to define an overflow chamber 78 below the opening 72. The overflow chamber 78 is illustrated in FIG. 6B as including the end wall 70. Alternatively, the end wall 70 can be omitted so that waste materials falling from the snout assembly 20 can be caught in the overflow chamber 78 and directed into the interior chamber 130.

FIG. 6A and FIG. 6B also illustrate a plurality of finger assemblies 80 mounted to the retainer assembly reinforcing framework 64 along the perimeter of the opening 72. The finger assemblies 80 can face toward the interior of the opening 72 and can be angled such that, when the hinged door 114 is closed, the finger bodies 81 can extend toward the waste container interior chamber 130 to thereby impede the movement of waste materials out of the interior chamber 130 through the opening 72. It will be recognized that opening dimensions, reinforcing framework dimensions, length and number of finger assemblies, and the like, can be selected based upon factors such as the size of the waste container, the size of the waste materials, the density of the waste materials, and the like.

In operation, the waste container 60 can be placed against the barrier 12 with the snout 24 and snout extension 26 engaged with and/or inserted through the opening 72 into the interior chamber 130. Waste materials discharged to the hopper assembly 40 can be moved through the snout assembly 20 and the opening 72 into the interior chamber 130 by movement of the ram 30 toward the waste container 60. As the ram 30 extends through the opening 72, it can encounter the finger bodies 81 and deflect them against the bias of the biasing element 97 away from the opening 72. The ram 30 can then be retracted, the finger surfaces 90 sliding along the perimeter of the ram 30, to return to an at-rest configuration when the ram 30 clears the opening 72. In the act-rest configuration, the finger bodies 81, particularly the acute tips 88, can impede the movement of waste materials out of the waste container interior chamber 130 until the waste opening doors 134 are closed.

Figure 7:
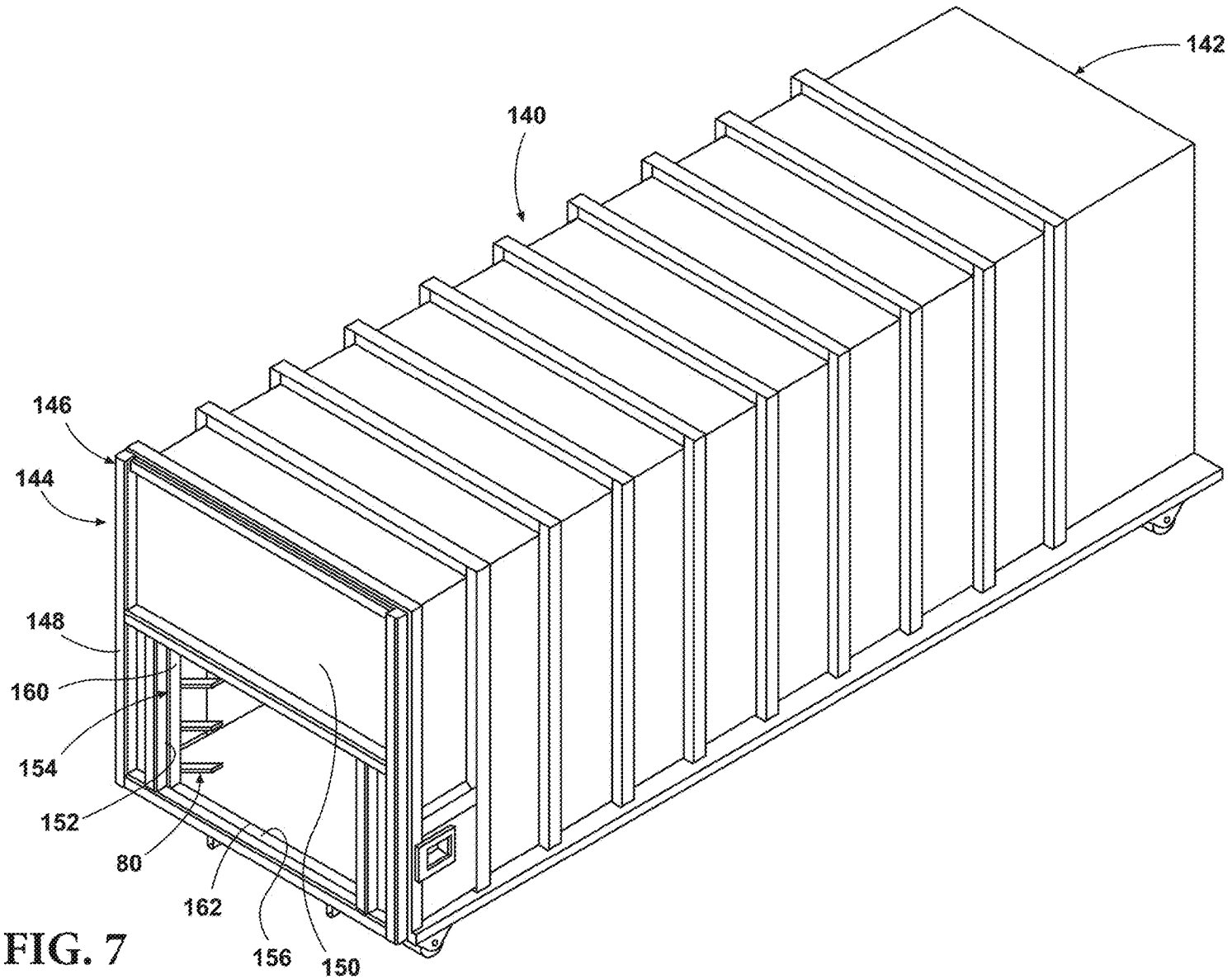
FIG. 7 is a first perspective view of another transportable waste container and retainer assembly according to another aspect of the present disclosure.
Figure 8:
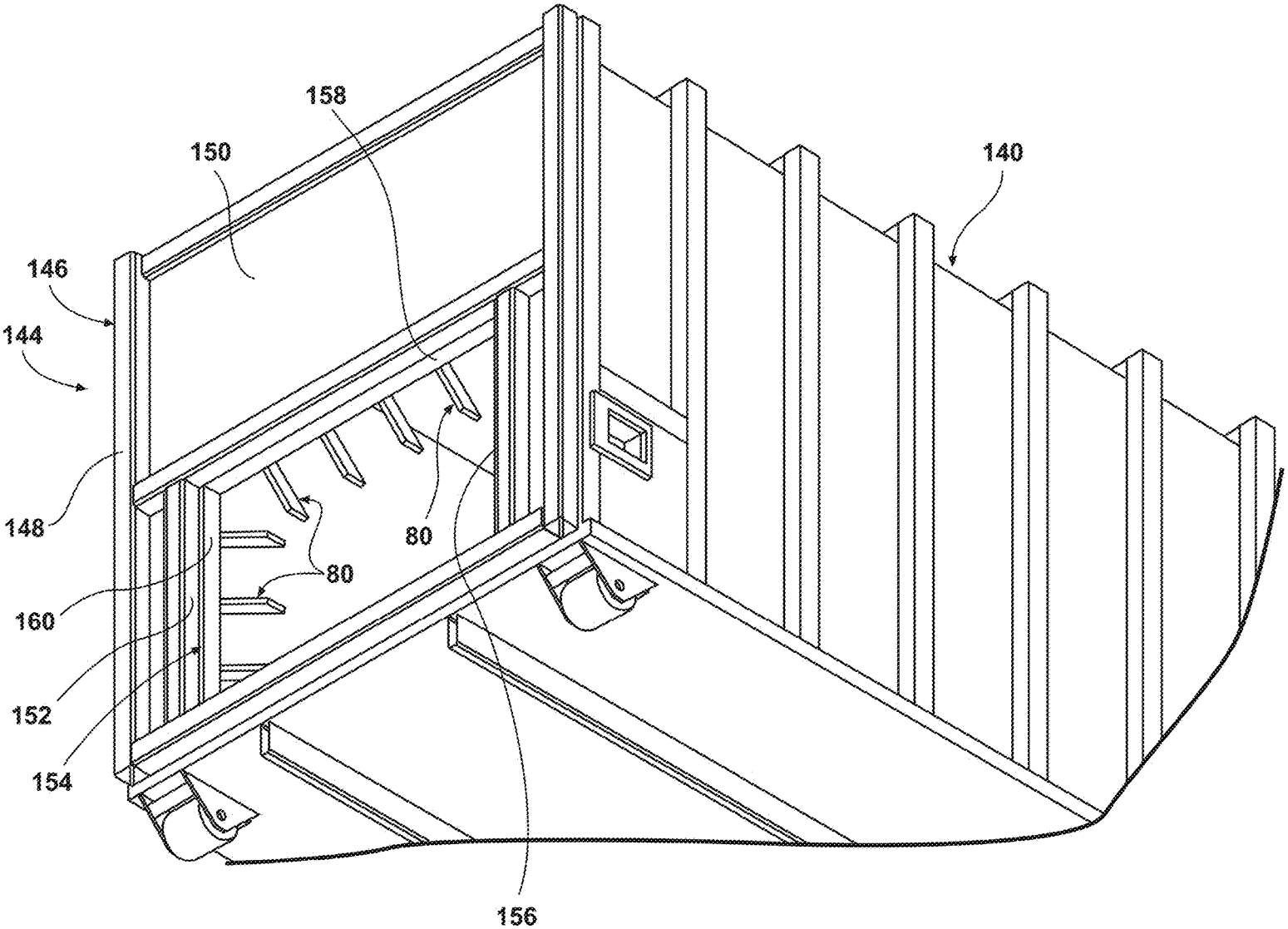
FIG. 8 is a second perspective view of the transportable waste container and retainer assembly illustrated in FIG. 7.

FIG. 7 and FIG. 8 illustrate another aspect of the present disclosure in which a waste container 140 which can include a retainer assembly 154, having an alternate waste opening 152. The waste container 140 can comprise a closed end 142 and an opening end 144, the opening end 144 comprising an end wall 146 including a right-angled reinforcing wall frame 148 supporting a wall panel 150. The wall panel 150 can include a right-angled waste opening 152 therethrough.

The end wall 146 is illustrated as fixed to the waste container 140, although the end wall 140 can be configured with hinges to enable opening and closing of the opening end 144.

Figure 9:
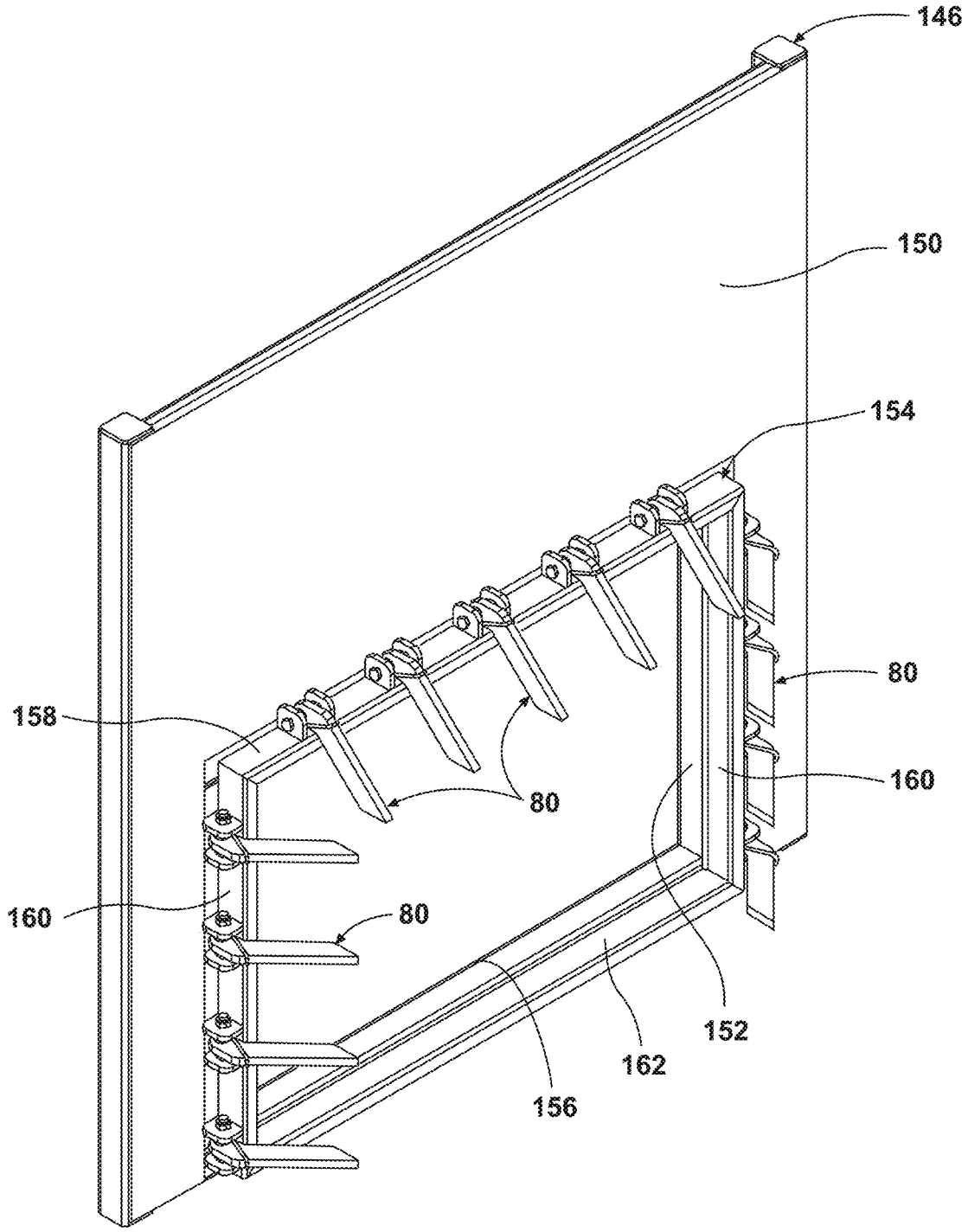
FIG. 9 is an enlarged perspective view of a wall panel mounting the retainer assembly illustrated in FIG. 7 and FIG. 8.
Figure 10A:
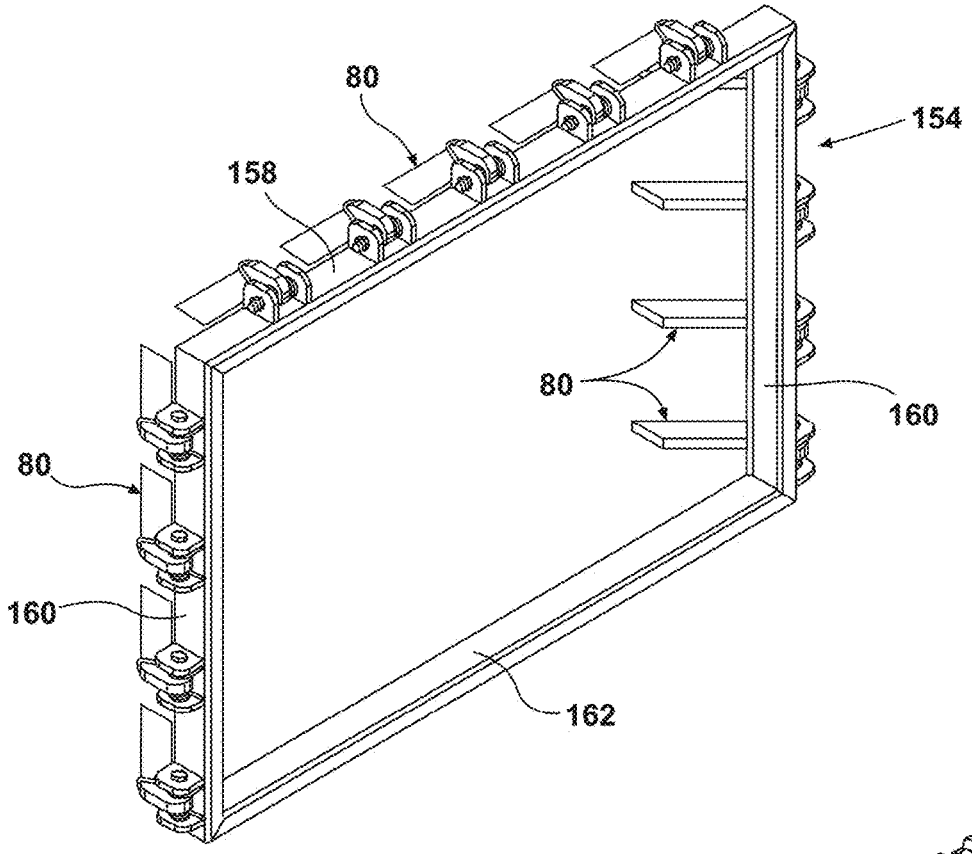
FIGS. 10A and 10B are enlarged perspective views of the retainer assembly illustrated in FIG. 9.
Figure 10B:
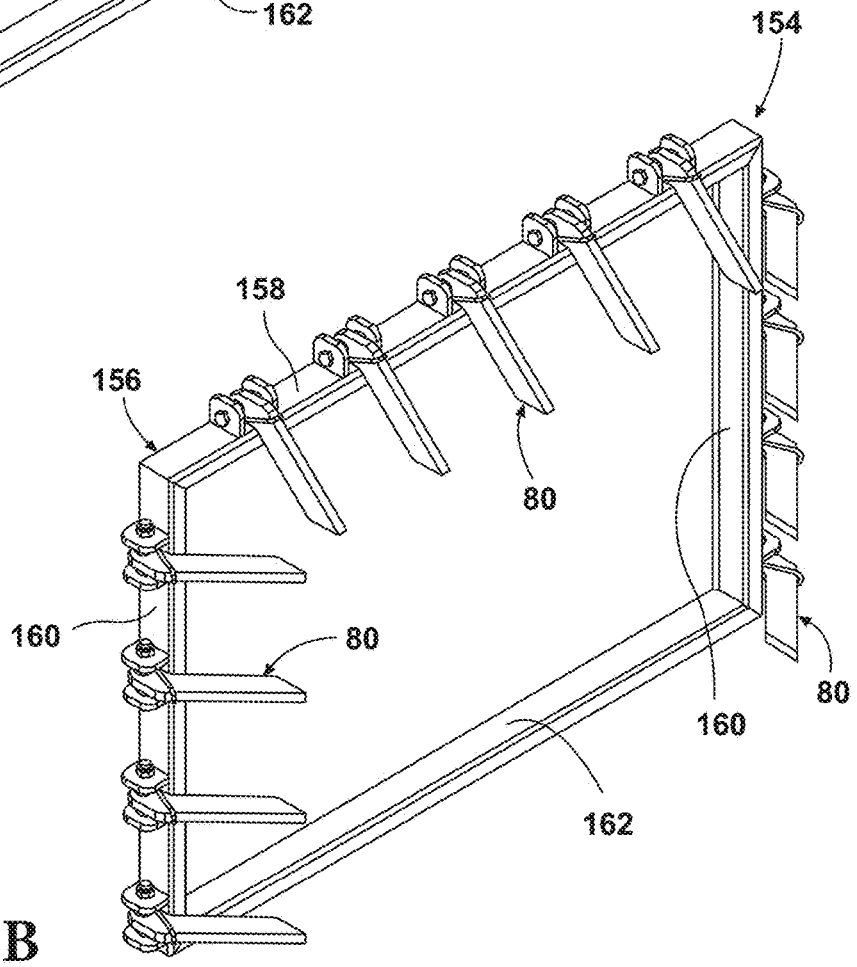

The retainer assembly 154 can be fixedly attached to the reinforcing wall frame 148 or wall panel 150 (FIG. 9). The retainer assembly 154 can comprise finger assemblies 80 attached to a top reinforcing frame member 158, a parallel spaced bottom reinforcing frame member 162, and a pair of parallel spaced side reinforcing frame members 160 coupled into a generally right-angled retainer reinforcing frame 156 (FIG. 10A and FIG. 10B).

The end wall 146 can be fixedly or removably attached to the opening end 144 so that the finger bodies 81 can extend toward the waste container interior chamber as described previously herein to thereby impede the movement of waste materials out of the interior chamber through the opening 152. As previously described herein, waste materials can be moved into the waste container 140 by reciprocal movement of a ram through the opening 152, and retained within the waste container 140 by the finger bodies 81.

Figure 11A:
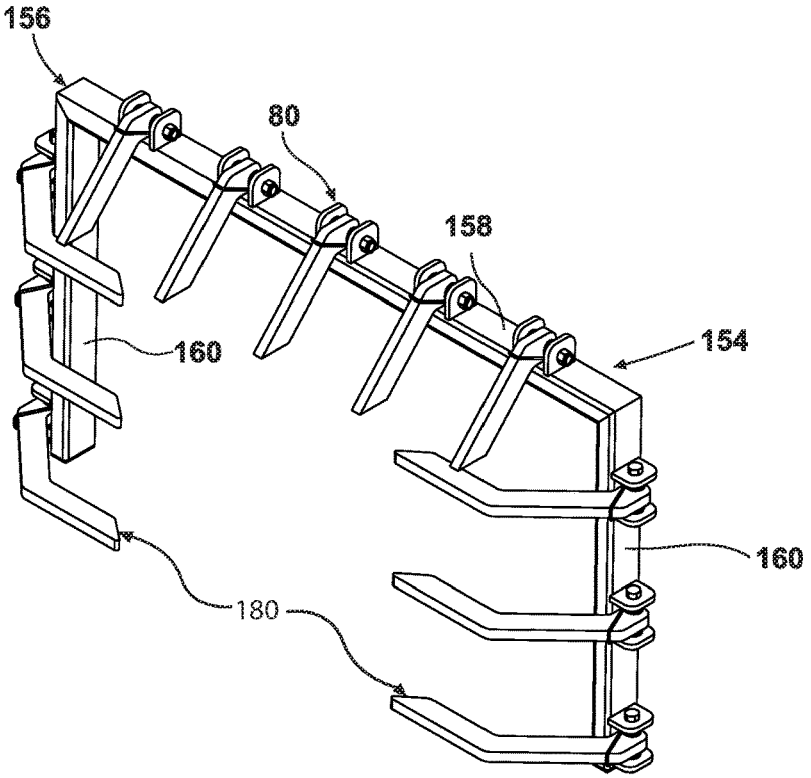
FIGS. 11A and 11B are enlarged perspective views of the retainer assembly that include both finger assemblies and elongated finger assemblies according to yet another aspect of the present disclosure.
Figure 11B:
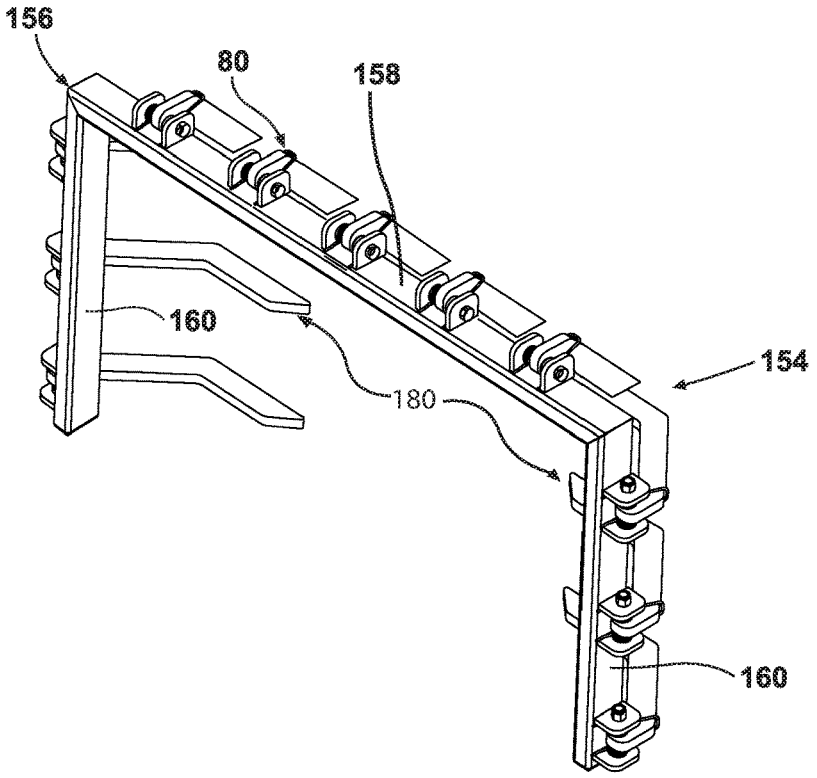

FIG. 11A and FIG. 11B illustrate the retainer assembly 154 according to yet another aspect of the present disclosure that include finger assemblies 80 and elongated finger assemblies 180. FIG. 11A and FIG. 11B illustrate finger assemblies 80 attached to the top reinforcing frame member 158. The elongated finger assemblies 180 couple to the parallel spaced side reinforcing frame members 160. It is contemplated that the finger assemblies 80 can be entirely replaced by the elongated finger assemblies 180 or any combination of the finger assemblies 80 and the elongated finger 180 assemblies can be mounted in any arrangement to the retainer assembly 54, 154. It is also contemplated that the shape, arrangement, composition, location, or coupling mechanism of the finger assembly 80 or elongated finger assembly 180 is not limited by the examples in the present disclosure.

The end wall 146 can be fixedly or removably attached to the opening end 144 so that the finger bodies 81 or elongated finger bodies 181 can extend toward the waste container interior chamber as described previously herein to thereby impede the movement of waste materials out of the interior chamber through the opening 152. As previously described herein, waste materials can be moved into the waste container 60, 140 by reciprocal movement of a ram through the opening 152, and retained within the waste container 60, 140 by a combination of one or more finger bodies 81 or one or more elongated finger bodies 181. The elongated finger body 181 is exemplary in design to maintain a significant amount of waste in the waste container 60, 140.

Figure 12:
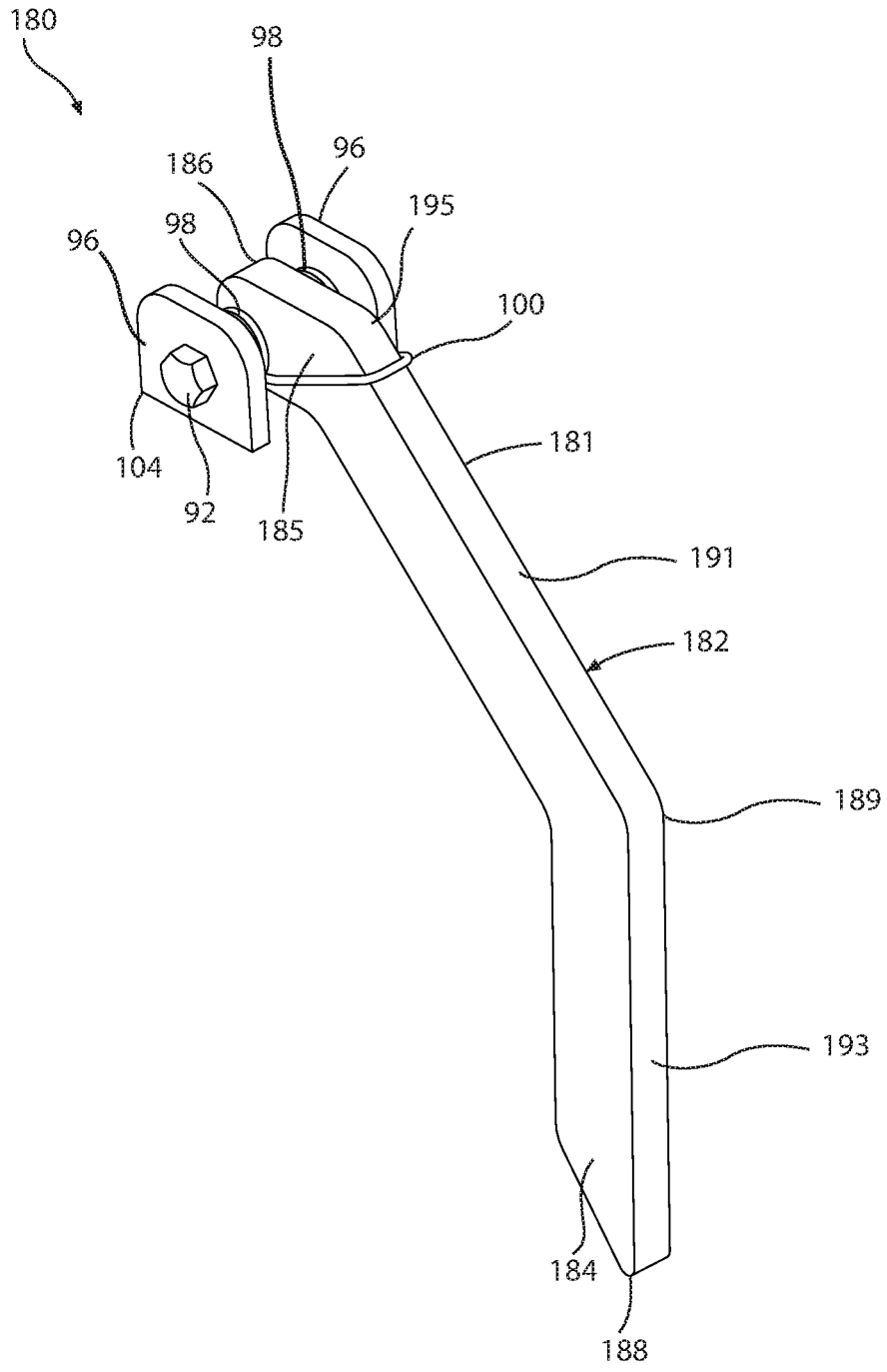
FIG. 12 is an enlarged perspective view of an elongated finger assembly from FIG. 11A and FIG. 11B.
Figure 13A:
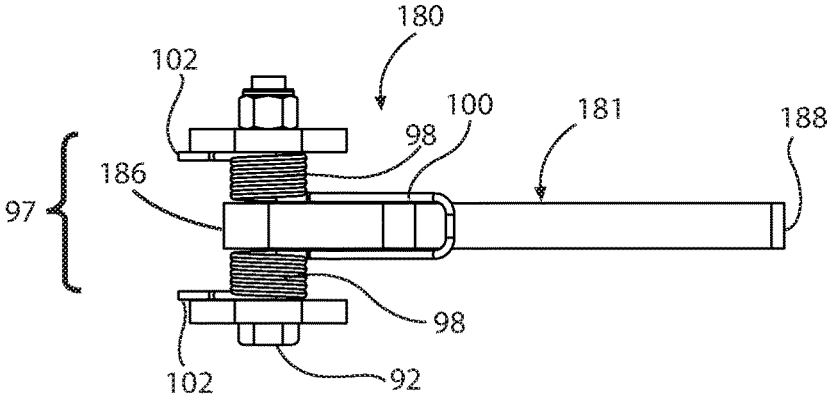
FIGS. 13A and 13B are additional enlarged perspective views of the elongated finger assembly of FIG. 12.
Figure 13B:
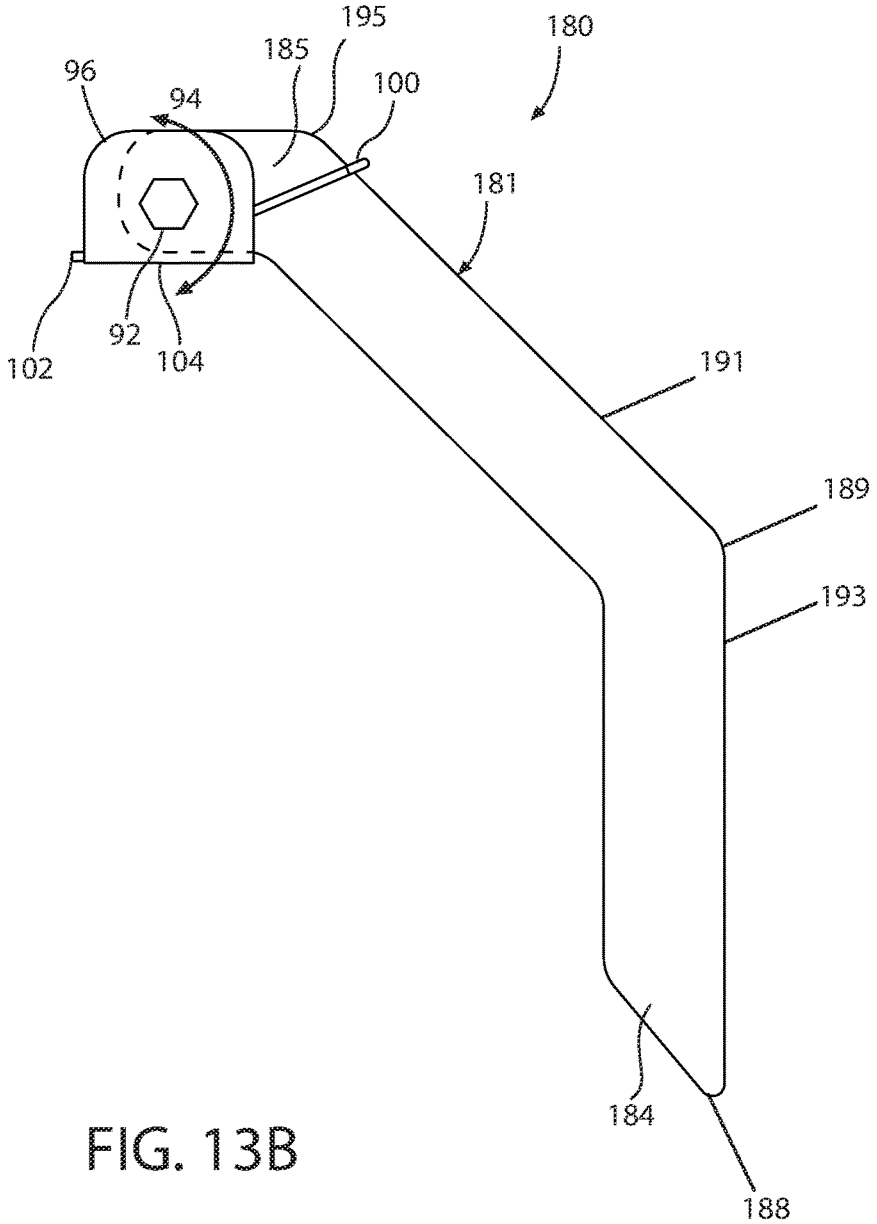

FIG. 12 illustrates the elongated finger assembly 180 from a similar perspective view as FIG. 5D for the finger assembly 80. FIG. 13A illustrates the elongated finger assembly 180 from a similar perspective view provided in FIG. 5C for the finger assembly 80. FIG. 13B illustrates the elongated finger assembly 180 from a similar perspective view provided in FIG. 5E for the finger assembly 80. Like parts will be identified with the same numerals as FIG. 5B-FIG. 5E, with it being understood that the description of the like parts remain the same unless otherwise noted.

The elongated finger assembly 180 includes an elongated retainer portion 182 terminating in a distal end 184, transitioning through a first portion 193, a first bend 189, a second portion 191, a second bend 195 to a relatively short pivot portion 185 terminating in a proximal end 186. The distal end 184 can be configured with an acute tip 188.

Similar to the finger assembly 80, the elongated finger assembly 180 can include the pair of plate-like finger brackets 96 in parallel, spaced-apart disposition can be positioned on both sides of the pivot portion 185 to enable pivotal movement of the elongated finger body 181 about the pivot pin 92. The finger brackets 96 can be provided with a circular pivot opening 197 (FIG. 14) and the bracket wall 104. The finger brackets 96 can be fixedly attached to the top member 56, 156, the side members 58, 158, and the intermediate member 108, such as by welding, along the bracket wall 104 so that the pivot portion 185 of the finger body 181 can be slidably received between the finger brackets 96 with the pivot openings in the finger brackets 96 and the pivot portion 185 coaxially aligned to receive the pivot pin 92 therethrough.

When assembled, the elongated finger body 181 can pivot about the pivot pin 92 alternately clockwise and counterclockwise as illustrated by the rotation vector 94 in FIG. 13B.

The biasing element 97 of the elongated finger assembly 180 can include the pair of helical wire biasing elements 98 joined by the biasing yoke 100 and terminating in the pair of bearing ends 102, also referred to as a torsion spring. The biasing elements 98 can be adapted to bracket the pivot portion 185 in coaxial alignment with the pivot pin 92, the pivot portion opening, and the finger bracket openings. The biasing yoke 100 can be adapted to cross over and engage the retainer portion 182 of the elongated finger body 181. The bearing ends 102 can be adapted to engage the top member 56, 156, side members 58, 158, and intermediate member 108 when the elongated finger body 181, finger brackets 96, and biasing element 97 are assembled into the elongated finger assembly 180.

The first bend 189 can occur such that the angle between the first portion 193 and the second portion 191 is 135 degrees. The second bend 195 can occur such that the angle between the second portion 191 and the pivot portion 185 is 135 degrees. When the elongated finger assembly 180 is in a biased closed position and the first and second bends 189, 195 are approximately 135 degrees, the first portion 193 is relatively perpendicular to the opening 152. In this preferred arrangement, the waste is significantly restricted from exiting through the opening 152 by the perpendicular position of the first portion 193 and the angled position of the second portion 191 of the retaining portion 182 of the elongated finger assembly 180.

Figure 14:
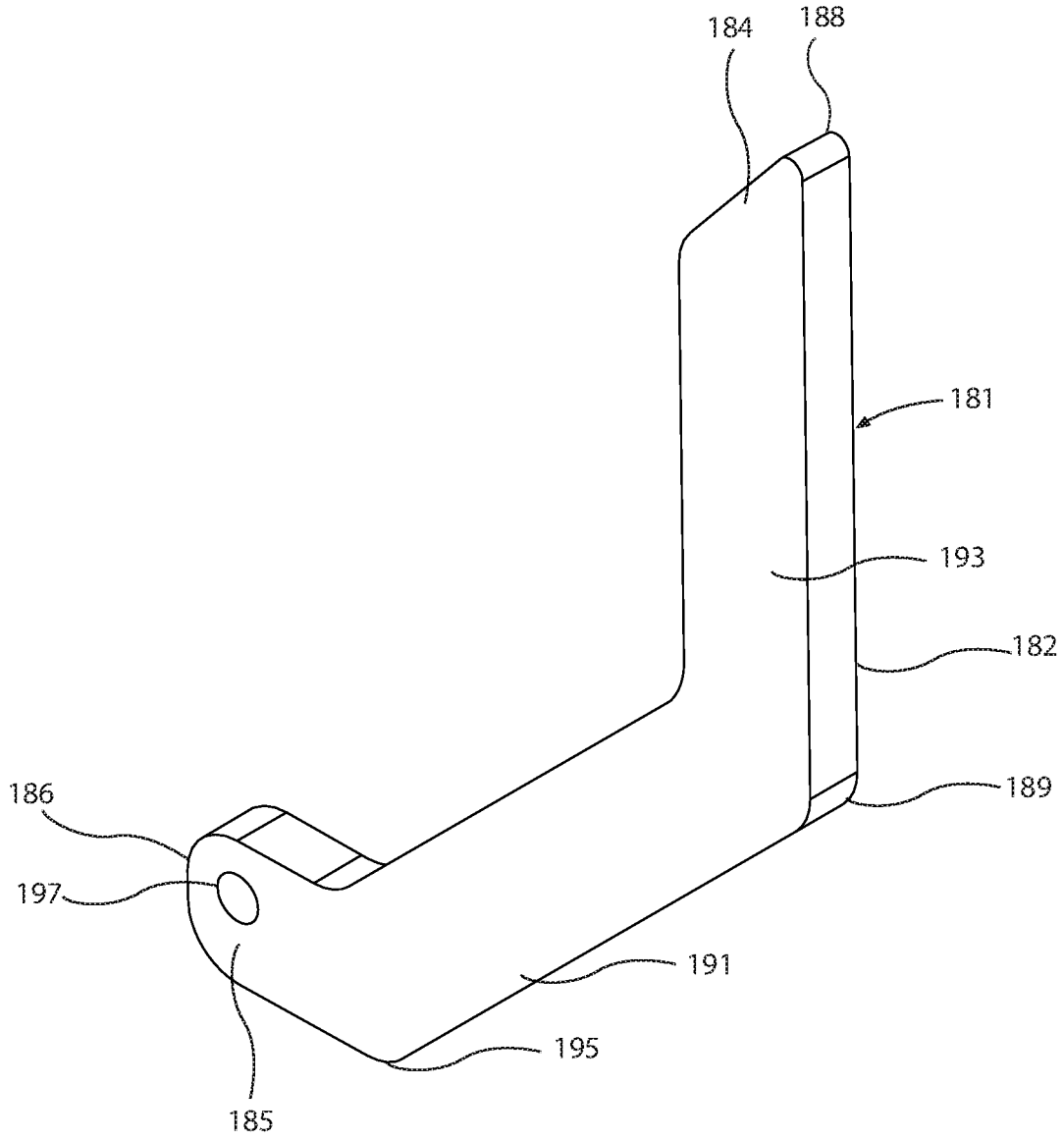
FIG. 14 is an enlarged perspective view of an elongated finger body.
Figure 15A:
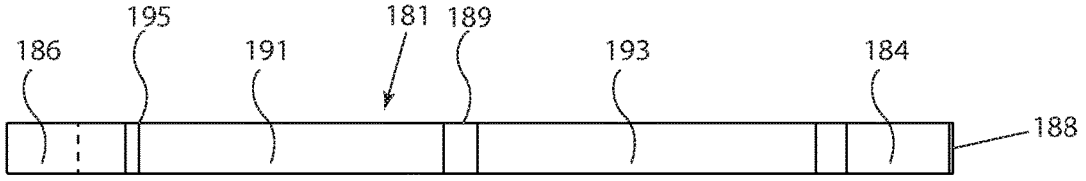
FIGS. 15A and 15B are additional enlarged perspective views of the finger body of FIG. 14.
Figure 15B:
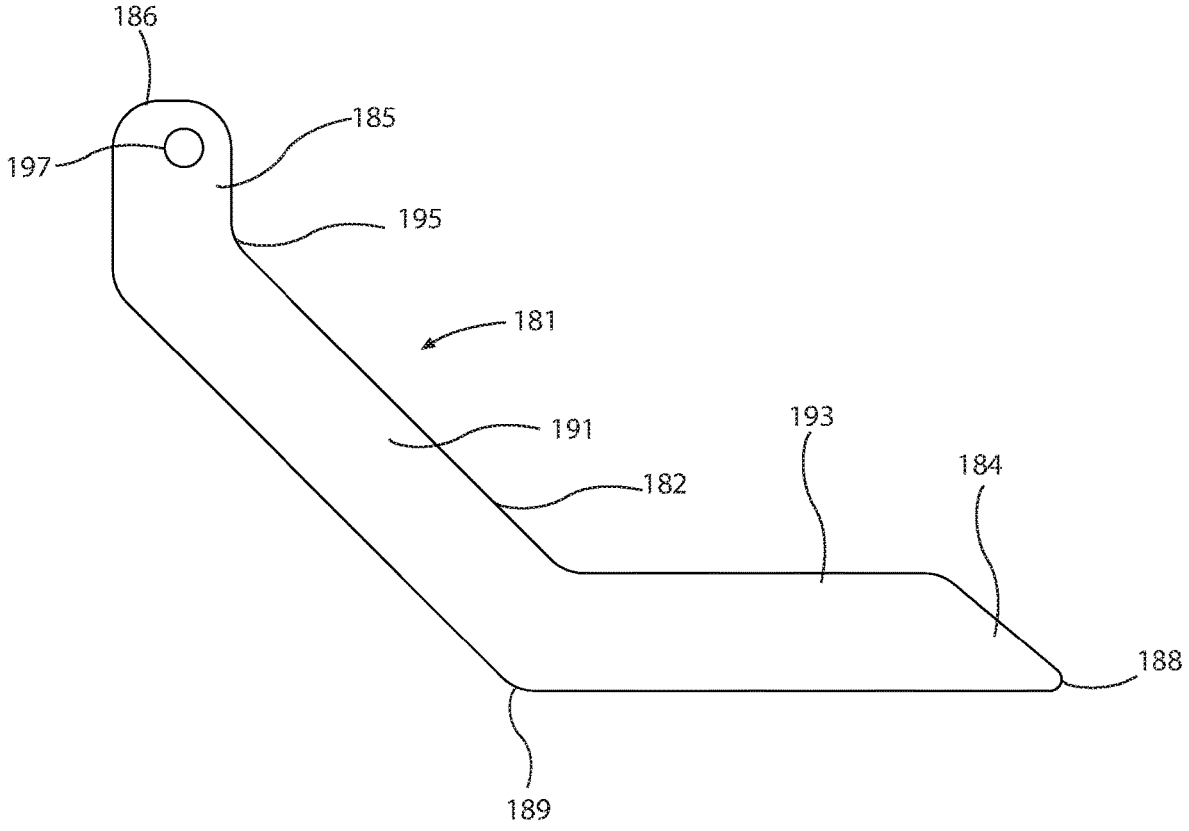

FIG. 14, FIG. 15A, and FIG. 15B illustrate a non-limiting example of the preferred arrangement for the elongated finger body 181 that pivots about the circular pivot opening 197.

The exemplary drawings are for purposes of illustration only and the dimensions, positions, order and relative sizes reflected in the drawings attached hereto can vary.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A retainer assembly for a waste container comprising:

a frame defining an opening, the frame configured to mount to the waste container having an interior, and the frame having a side adapted to face the interior;

a plurality of finger brackets on the frame, spaced from each other and positioned around most of the opening, each finger bracket having a pin;

a set of plate like fingers, each plate like finger having a proximal end pivotally mounted to the pin of each finger bracket and movable between a retaining position where a distal end extends at a first angle from the side adapted to face the interior toward the opening, and an open position where the distal end is free from the opening; and a torsion spring mounted between each finger bracket and each plate like finger to bias the plate like finger to the retaining position, wherein at least a portion of the pin is circumscribed by the torsion spring;

wherein each of a subset of plate like fingers in the retaining position has a proximal portion extending from the finger bracket and a distal portion that extends from the proximal portion at a second angle relative to a first portion.

2. The retainer assembly of claim 1 wherein the frame is rectangular and the set of plate like fingers extends from three sides of the rectangular frame.

3. The retainer assembly of claim 2 wherein the subset of plate like fingers extends from at least one side of the rectangular frame.

4. The retainer assembly of claim 2 wherein the subset of plate like fingers extends from opposing sides of the rectangular frame.

5. The retainer assembly of claim 1 wherein the distal end has an acute tip with a planar surface at an acute angle relative to a longitudinal axis of the plate like finger.

6. The retainer assembly of claim 5 wherein the acute tip faces away from the frame.

7. The retainer assembly of claim 1 wherein the torsion spring has a yoke that extends over the proximal portion.

8. The retainer assembly of claim 1 mounted to a door adapted to be hingedly mounted to the waste container.

9. A retainer assembly for a waste container comprising:

a frame defining an opening, the frame configured to mount to the waste container having an interior, and the frame having a side adapted to face the interior;

a plurality of finger brackets on the frame, spaced from each other and positioned around most of the opening, each finger bracket having a pin;

a set of plate like fingers, each plate like finger having a proximal end pivotally mounted to the pin of each finger bracket and movable between a retaining position where a distal end extends at a first angle from the side adapted to face the interior toward the opening, and an open position where the distal end is free from the opening; and helical wire biasing elements mounted between the plurality of finger brackets and the set of plate like fingers, wherein the helical wire biasing elements circumscribes at least a portion of the pin;

wherein each of a subset of plate like fingers has a proximal portion extending from the finger bracket and a distal portion that extends from the proximal portion wherein a bend is located between the distal portion and the proximal portion.

10. The retainer assembly of claim 9 wherein the frame is rectangular and the set of plate like fingers extends from three sides of the rectangular frame.

11. The retainer assembly of claim 10 wherein the subset of plate like fingers extends from at least one side of the rectangular frame.

12. The retainer assembly of claim 10 wherein the subset of plate like fingers extends from opposing sides of the rectangular frame.

13. The retainer assembly of claim 9 wherein the distal end has an acute tip with a planar surface at an acute angle relative to a longitudinal axis of the plate like finger.

14. The retainer assembly of claim 13 wherein the acute tip faces away from the frame.

15. The retainer assembly of claim 9 wherein the helical wire biasing elements include a torsion spring having a yoke that extends over the proximal portion.

16. The retainer assembly of claim 9 mounted to a door adapted to be hingedly mounted to the waste container.

17. The retainer assembly of claim 9 wherein the bend is a first bend and each of the subset of plate like fingers includes first portion at the distal end, the first bend between the first portion to a second portion, and a second bend transitioning from the second portion to a pivot portion terminating in the proximal end.

18. The retainer assembly of claim 17 wherein the first bend between the first portion and the second portion is 135 degrees.

19. The retainer assembly of claim 18 wherein the second bend between the second portion and the pivot portion is 135 degrees.

* * * * *